US012656003B2

(12) United States Patent
Kho et al.

(10) Patent No.: US 12,656,003 B2
(45) Date of Patent: Jun. 16, 2026

(54) AIR PURIFYING SYSTEM

(71) Applicant: Apicem Technology Services Company Limited, Hong Kong (CN)

(72) Inventors: Ahim Kho, Hong Kong (CN); Ho Man Kan, Hong Kong (CN)

(73) Assignee: Apicem Technology Services Company Limited, Hong Kong (CN)

( * ) Notice: Subject to any disclaimer, the term of this patent is extended or adjusted under 35 U.S.C. 154(b) by 961 days.

(21) Appl. No.: 17/680,406

(22) Filed: Feb. 25, 2022

(65) Prior Publication Data

US 2022/0282877 A1 Sep. 8, 2022

Related U.S. Application Data

(60) Provisional application No. 63/155,815, filed on Mar. 3, 2021.

(30) Foreign Application Priority Data

Aug. 3, 2021 (HK) ..... 32021035965.1

(51) Int. Cl.
*F24F 8/22* (2021.01)
*F24F 11/89* (2018.01)
(Continued)

(52) U.S. Cl.
CPC ..... *F24F 8/22* (2021.01); *F24F 11/89* (2018.01); *F24F 13/20* (2013.01); *F24F 13/28* (2013.01)

(58) Field of Classification Search
CPC .. F24F 11/89; F24F 13/20; F24F 13/28; F24F 3/16; F24F 8/192; F24F 8/22; F24F 1/00;
(Continued)

(56) References Cited

U.S. PATENT DOCUMENTS 11,260,143 B2 * 3/2022 Jeong ..... A61L 9/205
2007/0245898 A1 * 10/2007 Naito ..... B01D 53/32 96/65
(Continued)

FOREIGN PATENT DOCUMENTS

CN 1843514 A * 10/2006
CN 103949345 A 7/2014
(Continued)

OTHER PUBLICATIONS

Linmao Liu , Jingfu Guo , Jie Li , Lianxi Sheng. The effect of wire heating and configuration on ozone emission in a negative ion generator. Journal of Electrostatics, vol. 48, Issue 2, Jan. 2000, pp. 81-91 (Year: 2000).*
(Continued)

*Primary Examiner* — Brian W Cohen
*Assistant Examiner* — Nathanael Jason Downes
(74) *Attorney, Agent, or Firm* — Renner, Kenner, Greive, Bobak, Taylor & Weber Co., LPA

(57) ABSTRACT

An air purifying module for use in air channel of an air handling unit of a central air conditioning system, comprising a first housing having air inlet surface and air exhaust surface to enable airflow, a panel member that is detachably installed in the first housing, the panel member comprises filter panel, two metal foam panels and a number of photocatalyst coated metal foam panels arranged in parallel in the direction from the air inlet surface to the air exhaust surface, a shortwave UV light member installed in the first housing, a control unit and a high voltage direct current generator installed in the external of the first housing. The air purifying module can effectively inactivate bacteria and pathogens, filter out volatile organic compounds, thereby providing highly efficient air purification and sterilization functions.

15 Claims, 3 Drawing Sheets

(51) Int. Cl.
*F24F 13/20* (2006.01)
*F24F 13/28* (2006.01)

(58) Field of Classification Search
CPC ..... F24F 3/00; F24F 5/00; F24F 7/00; F24F 6/00; F24F 9/00; F24F 8/00; F24F 11/00; F24F 12/00; F24F 13/00; F24F 2110/00; F24F 2120/00; F24F 2130/00; F24F 2140/00; F24F 2203/00; F24F 2221/00
See application file for complete search history.

(56) References Cited

U.S. PATENT DOCUMENTS

| | | | | |
|---|---|---|---|---|
| 2018/0164203 | A1* | 6/2018 | Koerber | B03C 3/06 |
| 2020/0166235 | A1* | 5/2020 | Marra | F24F 7/003 |

FOREIGN PATENT DOCUMENTS

| | | | | | |
|---|---|---|---|---|---|
| CN | 204268589 | U | * | 4/2015 | |
| CN | 205338425 | U | * | 6/2016 | |
| CN | 2065454985 | U | | 10/2017 | |
| CN | 109331543 | A | * | 2/2019 | B01D 53/8687 |
| CN | 1093315443 | A | | 2/2019 | |
| CN | 209726389 | U | | 12/2019 | |
| JP | 2010043783 | A | | 2/2010 | |

OTHER PUBLICATIONS

CN204268589U—A kind of efficiency air cleaning device—Google Patents English Translation (Year: 2025).*
CN205338425U—Pillow—Google Patents English Translation (Year: 2025).*
CN1843514A—Static reinforced nano photocatalytic air disinfection and clarification device—Google Patents English Translation (Year: 2025).*
CN109331543A_Chen—English translation (Year: 2018).*
Mark Lawrence Lipham Jr. Thesis "Electrical Breakdown Studies of Partial Pressure Argon Under KHz Range Pulse Voltages" Auburn University (Year: 2010).*
Search Report obtained for HK32021035965.1 dated Dec. 8, 2021.

* cited by examiner

AIR PURIFYING SYSTEM

CROSS REFERENCE TO RELATED APPLICATIONS

The present U.S. non-provisional application claims the benefit of U.S. provisional application No. 63/155,815 filed on 3 Mar. 2021 and claims priority to Hong Kong short-term patent application 32021035965.1 filed on 3 Aug. 2021, disclosures of each are incorporated by reference herein in their entirety.

TECHNICAL FIELD

The present invention relates a system for use in the air handling unit (AHU) of a central air-conditioning system. The invention, more particularly, relates to a smart air purifying module built in the air passage of an air handling unit to provide smart air purifying capability to the environment.

BACKGROUND OF THE INVENTION

Nowadays, most of the air purifying devices are equipped with traditional fibrous filters. Those traditional air filters, include high efficiency particulate air (HEPA) filters, are produced based on flat surface fiber filtering techniques. The raw materials used are basically paper and plastic fibers, weaving together to produce a filter of dense reticular meshwork and a required thickness. Due to the physical barrier and adhesion effect, these filters show good capture efficiency for particulate matter (PM), meeting the high efficiency particulate air standard. Significant disadvantages exist for these existing fibrous filters, including high air resistance and limited inhibition ability against harmful microorganisms. Furthermore, their effective filter area is much smaller than the surface area, so that the filters had to fold into many layers in order to increase surface area to achieve a desired volume ratio. Since the filter is made of paper and plastic, it is non-heat-resistant, non-moisture-resistant, and is unable to be used for an extended period. Plastic made filters are not disposable, it creates additional secondary pollution when being discarded, that is, non-recyclable material and allow growth of microorganisms to continue. As such, a new biodegradable filter has to be used.

Biodegradable reticulated aliphatic polyurethane memory foam and metal foam are introduced in this invention. The reticulated aliphatic polyurethane memory foam is disclosed in China patent ZL200810178640.6. disclosure thereof is incorporated herein by reference. The foam is prepared by adjusting the amount and type of polyol, polyisocyanate, surfactant, crosslinking agent, catalyst or other additives. The metal foam can be prepared by using gold, silver, copper, iron, nickel, zinc, tin, titanium, lead, stainless steel or other alloys. Both memory foam and metal foam have the same characteristics of high air permeability and low air resistance, and most important of all, they are both biodegradable.

All bacteria and virus have to attach to some kind of matter, either particulate matter (PM) or some kind of water vapors or aerosols in order to spread around. A way to capture those PM, aerosols becomes important. Static electricity in combination of metal foam is the ideal mechanism.

Pulse sterilization, which is a method of inactivation of cells by high voltage pulsed electric field, can cause the destruction of cell membrane and cell death. Because the generated heat is relatively low, this method has the advantage of sterilizing those harmful contaminants without denaturation of the physiological compounds of the object being sterilized. The history of pulse sterilization started as early as 1967 in Britain. RF (Radio Frequency) electric field was used but the result was unsatisfactory, because the electric field is less than 2 KV/cm (Sale, 1967) is not strong enough to kill bacteria. After all, 25 kV/cm DC (Direct Current) pulse was found to be effective in killing bacteria and yeast. The elimination rate is determined by the electric pulse width and number of discharge, as well as the strength of electric field in water. All kinds of bacteria have different sensitivity to electric field, yeast is more sensitive than nutritional bacteria. Experiment shows the dissolution of erythrocytes and protoplasm, the leakage of intercellular substances, inactivation of *Escherichia coli* and the relaxation of lactoxicillic acid. It is concluded that electric field causes irreversible damage to the function of semi permeable barrier of cell membrane and leads to death of the cell. Since the metal foam is metallic in nature and electricity can be conducted, when the harmful contaminants are captured in its microspore, when pulsed high voltage DC static current is discharged, the captured biological contaminants can instantly be killed. Although the voltage of high-voltage static electricity is high, due to the small current, it is found by the inventors of the present invention that there is no danger to human life even when the high-voltage static electricity is 20,000 volts. However, electrostatic discharge also generates electromagnetic fields around it, although the duration is short, but the intensity is high. Extensive safety measure such as insulation and sensor-based power switch has to be built to safeguard all emergency situation.

Germicidal ultraviolet—shortwave UV or UV-C, which includes germicidal ultraviolet at 253.7 nm wavelength—is used for air, surface and water disinfection. It kills germs, such as bacteria, viruses, mold, fungi and spores, that transmit infections, cause allergies, trigger asthma attacks or cause other unhealthy effects. Unintentional overexposure to UV-C causes skin redness and eye irritation, but, according to Dr. Nardell, at The Harvard Medical School, it does not cause skin cancer or cataracts. UV technically does not directly "kill" bacteria, but rather it inhibits replication, or sterilizes it, by destroying the DNA. A more detailed explanation is that the UV-C energy is absorbed by the DNA and RNA contained in the cells, and this creates dimers or a "double bond" between adjacent nucleotides (i.e., thymine). The formation of these dimers is what inhibits the ability of the chain to replicate, which in turn leads to the death of the colony. The time required for UV disinfection is related to UV intensity and time, the higher the UV intensity, the shorter the contact time is required. Normally it takes a few minutes to complete a round of disinfection in open air. Properly designed and application of HVAC coil disinfection UV systems help to keep the coils clean and free of microbial growth, reduce energy use and maintenance costs. The best industry practice as recommended by American Society of Heating, Refrigerating and Air-Conditioning Engineers (ASHRAE Handbook—HVAC Applications, Chapter 62, Ultraviolet Air and Surface Treatment) is to combine UV coil disinfection with air-stream irradiation for the most effective UV solution. Based on the same principle, germicidal ultraviolet is added in this invention to augment the germicidal effect.

Heterogeneous photocatalysis emerges to be an efficient and cost-effective approach to eliminate biological pollution. The generated reactive oxygen species (ROS), such as hydroxyl radical (OH), superoxide (O2-), singlet oxygen (1O2), and hydrogen peroxide (H2O2), can act as strong oxidants to destroy harmful microorganisms. Semiconductors like zinc oxide (ZnO) and titanium dioxide (TiO2) are potential photocatalysts with biocidal activity and exhibit good performance in air disinfection. However, their disinfection efficiency is far from satisfactory, especially under high air flow velocity combined with other contaminants like PM and volatile organic chemicals (VOCs). The metal foam has various crucial properties including large surface area, high porosity, well-dispersed active centers, and adjustable functionalities. Not only is metal foam good for air filtration but it is also a promising heterogeneous photocatalysts for air pollutants oxidation. In particular, metal foam provides an opportunity to optimize the photocatalytic performance at the molecular level by adjusting metal clusters or organic linkers reasonably, which is believed to have a significant competitive advantage over traditional conductors. Due to its remarkable design, metal foam has been successfully applied in photocatalysis, carbon dioxide reduction as well as oxidation of reactive oxygen species (ROS) based toxic chemicals.

The present application provides an air purification module with high efficiency, safety and simple structure. The module of the present invention can be adapted to be installed in the air handling units of different central air-conditioning systems or as an independent air purification device and can be conveniently applied to different buildings or indoor environments to improve indoor air quality.

SUMMARY OF THE INVENTION

The present application aims to solve one or more of the above-mentioned technical problems to a certain extent. Therefore, according to one aspect of the present application, the present application provides an air purification module for used in the air passage of the air handling unit of the central air conditioning system. The air purification module comprises a first housing, the first housing includes a closed surface, an air inlet surface and an exhaust surface that allow airflow; a panel member: the panel member is detachably installed inside the first housing; a short-wave ultraviolet lamp member, the short-wave ultraviolet lamp is assembled inside the first housing; a control unit, the control unit is installed in a second housing outside of the first housing; and a high-voltage direct current generator, the high-voltage direct current generator is installed in a third housing outside of the first housing. The panel member includes: a first panel, the first panel includes a pre-filter panel; a second panel, the second panel includes adjacently arranged first foam metal panel and a second foam metal panel, the first foam metal panel and the second foam metal panel are respectively connected to positive and negative electrodes of the high-voltage direct current generator; a third panel, the third panel includes a plurality of third panels having photocatalyst coatings. The foam metal panel, wherein the first panel, the second panel and the third panel are sequentially arranged in parallel in the direction from the air inlet surface to the air exhaust surface.

According to one embodiment of the present invention, the pre-filter panel comprises degradable soft polyurethane low-resilience memory foam, and the pre-filter panel comprises a first sensor for monitoring cleanliness of the pre-filter panel).

According to one embodiment of the present invention, the short-wave ultraviolet lamp member comprises one or more shortwave UV lamps installed between the second panel and the third panel.

According to one embodiment of the present invention, the short-wave ultraviolet lamp member comprises one or more LED-based shortwave UV light strips installed between the second panel and the third panel.

According to one embodiment of the present invention, the first foam metal panel and the second foam metal panel each comprising a second sensor for monitoring voltage applied to the second panel.

According to another embodiment of the present invention, the first foam metal panel and the second foam metal panel is separated by a gap of at least 15 cm, and outer edges of the first foam metal panel and the second foam metal panel are tightly sealed by insulating material.

According to one embodiment of the present invention, the photocatalyst layer on the third foam metal panel is a titanium dioxide electroplating layer.

According to one embodiment of the present invention, the air purification module is connected to an external power source.

According to one embodiment of the present invention, the first housing, the second housing and the third housing each include a door having a door sensor installed on the door, the door sensor being in communication with an external power source for controlling the disconnection of the external power source when the door is opened.

According to the one embodiment of the present invention, the third panels are replaced by one or more high-efficiency particulate air (HEPA) filter panels.

According to a second aspect of the present application, the present application further provides an air purification device, comprising the above-mentioned air purification module and a fan, wherein the fan is installed on the inner side of the air purification module to guide airflow from the air inlet surface flow to the exhaust surface.

BRIEF DESCRIPTION OF THE DRAWINGS

The drawings described herein are for illustration purposes only and are not intended to limit the scope of the present application in any way.

REFERENCE NUMBER

Figure 1:
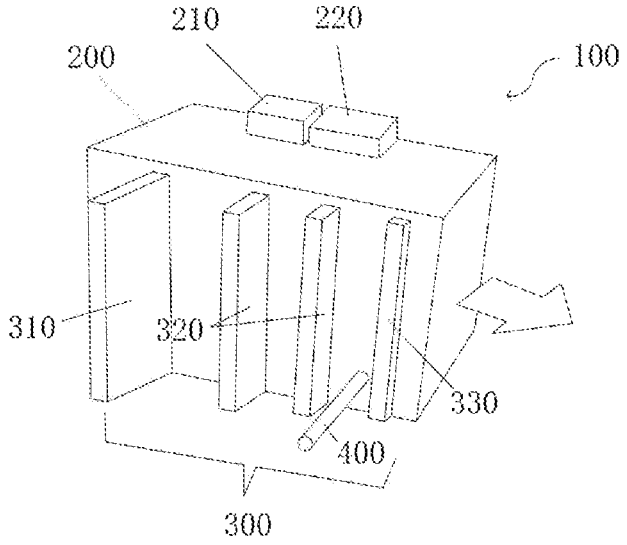
FIG. 1 is an exploded schematic diagram of the structure of an air purification module provided according to an embodiment of the present application.

100 Air purification modules
200 First housing
202 Closed surface
204 Air inlet surface
206 Air exhaust surface
210 Second housing
220 Third housing
230 Doors

232 Door sensor
300 Panel member
310 First panel
312 Pre-filter panel
314 First sensor
320 Second panel
322 First foam metal panel
324 Second foam metal panel
326 Second sensor
330 Third panel
332 Third foam metal panel
400 Short wave UV lamp member
500 Control unit
600 High voltage direct current generator
700 External power
800 fan

DETAILED DESCRIPTION OF THE INVENTION

In order to illustrate the objectives, technical solutions and advantages of the present application clearer, the embodiments of the present application will be described in detail below with reference to the accompanying drawings. It should be noted that, the embodiments in the present application and the features in the embodiments may be arbitrarily combined with each other if there is no conflict.

Figure 2:
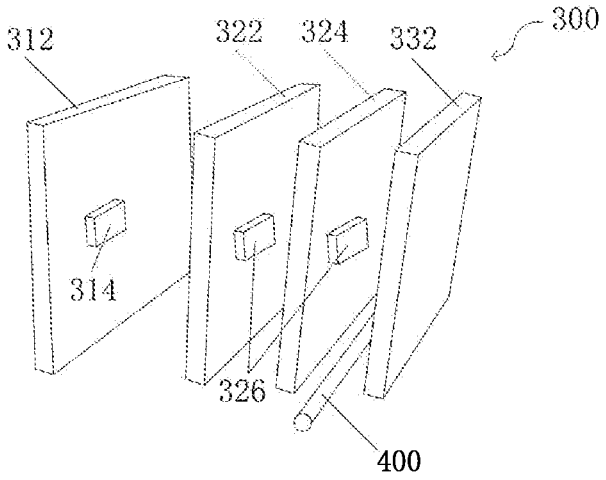
FIG. 2 is a schematic perspective view of the structure of a panel member and a short-wave ultraviolet lamp member provided according to an embodiment of the present application.
Figure 3:
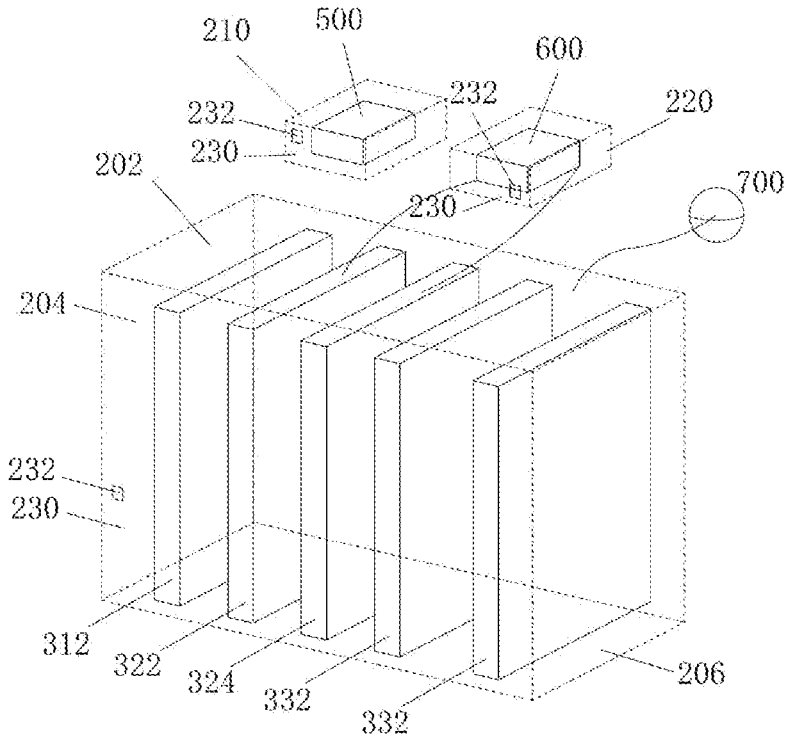
FIG. 3 is a schematic perspective view of the structure of an air purification module provided according to another embodiment of the present application.

Referring to FIGS. 1 to 3, a air purification module 100 in the present application will be described below according to an embodiment of the present application. Referring to FIG. 1, FIG. 1 is an exploded schematic view of the structure of an air purification module provided according to an embodiment of the present application. The shape of the air purification module 100 in FIG. 1 adopts a rectangle shape is just for illustration purpose only. In fact, the shape and size of the air purification module 100 may be formed into a square, a rectangle or any other shapes according to the actual environment of the air passage in the air handling unit.

The air purification module 100 includes: a first housing 200, the first housing 200 includes a closed surface 202, an air inlet surface 204 and an air exhaust surface 206 that allow airflow; a panel member 300; a short-wave ultraviolet lamp member 400; a control unit 500; and DC high voltage generator 600. The air inlet and exhaust surfaces may include air inlets and air outlets, respectively. In one embodiment, the air inlet is disposed on the closed surface close to the air inlet surface. In another embodiment, the air outlet is provided on the closed surface in proximity to the air exhaust surface. The actual location of the air inlet and outlet depends on the actual environment within the air handling unit or the design needs of the air purifying unit.

The panel member 300 includes a first panel 310, which includes a pre-filter panel 312; a second panel 320 having a first foam metal panel 322 and a second foam metal panel 324 that are adjacently arranged. A foam metal panel 322 and a second foam metal panel 324 are respectively connected to the positive and negative electrodes of the HVDC generator 600; and a third panel 330, the third panel 330 includes a plurality of third foam metal panels 332 having photocatalyst coating. The first panel 310, the second panel 320 and the third panel 330 are sequentially arranged in parallel in a direction from the air inlet surface 204 to the air exhaust surface 206. The arrows in FIG. 1 show the direction of airflow. In one embodiment, the high voltage direct current is 20,000 volts/cm or more. Wherein, there is at least 15 cm distance between one or more panels of the panel group.

Continuing to refer to FIG. 1, the first housing 200 is a custom-made metal housing, and the size and configuration of the first housing 200 must be adapted to the air passage in which it is located. The panel member 300 and the short-wave ultraviolet lamp member 400 are accommodated inside the first housing 200. The control unit 500 is installed in the second housing 210 outside of the first housing 200. The second housing 210 is also a metal housing. The control unit 500 is used to remotely monitor the operation of all sensors in the first housing 200. The high voltage direct current generator 600 is installed in the third housing 220 outside of the first housing 200, and the third housing 220 is also a metal housing.

Referring to FIG. 2, FIG. 2 is a three-dimensional schematic diagram of the structure of a panel member and a short-wave ultraviolet lamp member provided according to an embodiment of the present application. According to an embodiment of the present application, the pre-filter panel 312 is made of degradable soft polyurethane low-resilience memory foam, the pre-filter panel 312 includes a first sensor 314, and the first sensor is used to monitor the cleanliness level of the pre-filter panel 312, the sensor can issue a warning to notify maintenance personnel when the cleanliness of the pre-filter panel 312 falls below a predetermined threshold.

According to an embodiment of the present application, the first foam metal panel 322 and the second foam metal panel 324 each comprise a second sensor 326, and the second sensor 326 is used to monitor the voltage of the power applied to the second panel 320 to ensure that the strength of the power transmission is sufficient to perform the decontamination process.

At the same time, the first foam metal panel 322 and the second foam metal panel 324 are separated by a gap of at least 15 cm and the outer edges of the first foam metal panel 322 and the second foam metal panel 324 are tightly sealed with insulating materials to avoid possible sparks and the resulting danger. The gaps between the foam metal panels of the present application allow the use of high voltages (e.g., 20,000 volts/cm or more) to kill harmful substances safely even in the air.

According to an embodiment of the present application, the photocatalyst coating on the third foam metal panel 332 is a titanium dioxide electroplating layer. Those skilled participants in the field can also use other suitable photocatalyst materials as an alternative, and the photocatalyst layer can be directly used as a catalyst to provide oxidation to air pollution to improve the purification ability of the third foamed metal panel 332. In other embodiment, the third panel may be one or more high efficiency particulate air (HEPA) filter panels.

According to actual requirements, each panel or short-wave ultraviolet lamp in the panel member 300 and the short-wave ultraviolet lamp member 400 can be disassembled for regular maintenance and cleaning, or even replaced with a new panel or short-wave ultraviolet lamp.

Figure 4:
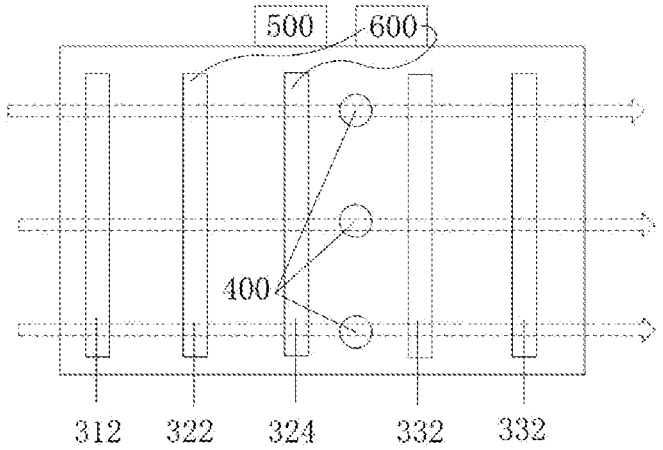
FIG. 4 is a schematic side view of the structure of an air purification module provided according to another embodiment of the present application.
Figure 5:
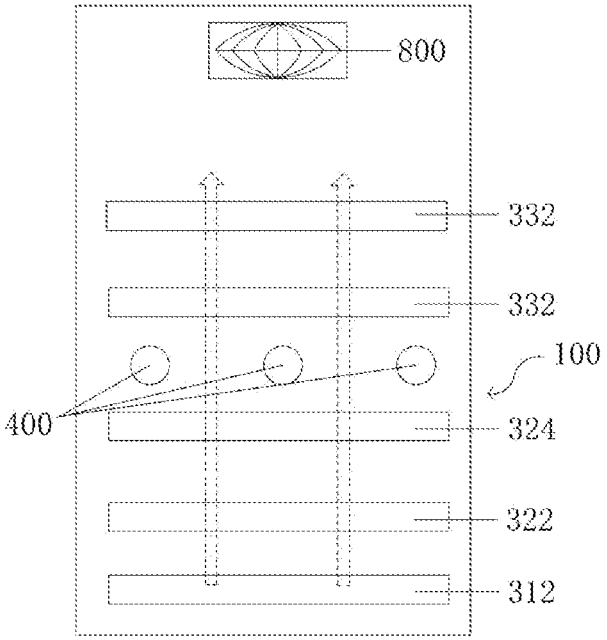
FIG. 5 is a schematic side view of the structure of an air purification device provided according to an embodiment of the present application.

Referring to FIGS. 3 to 4, a air purification module 100 will be described below according to another embodiment of the present application. The arrows in FIG. 4 show the direction of airflow. The air purification module 100 includes a first housing 200, the first housing 200 includes a closed surface 202, an air inlet surface 204 and an air exhaust surface 206 that allow airflow; a panel member 300; a short-wave ultraviolet lamp member 400; a control unit 500; and DC high voltage generator 600. The number and position of the lamps of the short-wave ultraviolet lamp member are not limited, and the number of lamps of the short-wave ultraviolet lamp member of the present application may be one (as shown in FIG. 1), two or more. As shown in FIGS. 4 and 5, the short-wave ultraviolet lamp member may have three lamps evenly distributed between the second panel (320) and the third panel (330).

The panel member 300 includes a first panel 310, which includes a pre-filter panel 312; a second panel 320 including a first foam metal panel 322 and a second foam metal panel 324 that are adjacently arranged. A foam metal panel 322 and a second foam metal panel 324 are respectively connected to the positive and negative electrodes of the high voltage direct current generator 600; the third panel 330 includes a plurality of third foam metal panels 332 having photocatalyst coatings. Wherein, the first panel 310, the second panel 320 and the third panel 330 are sequentially arranged in parallel in the direction from the inlet surface 204 to the air exhaust surface 206.

Referring to FIG. 3, FIG. 3 is a schematic perspective view of the structure of an air purification module provided according to another embodiment of the present application. In order to facilitate understanding of the positions and connection relationships of components in the metal housing, the first housing 200, the second housing 210 and the third housing 220 in FIG. 3 are all drawn with dotted lines. The above three metal housings each have separate doors 230 for maintenance personnel to open these metal housings and inspect the panel member 300, the short-wave ultraviolet lamp member 400, the control unit 500 or the high voltage direct current generator 600 therein. A door sensor 232 is also configured on the door 230 to control and to record the movement of the door 230 of the metal housing. In particular, when the door 230 corresponding to the panel member 300 and the short-wave ultraviolet lamp member 400 or the DC high voltage generator 600 is opened, the door sensor 232 will indicate to the external power supply 700 connected to the air purification module 100 to automatically disconnect, so that the user or the maintenance workers can safely follow up with the relevant workflow. On the contrary, when the door corresponding to the control unit 500 is opened, the door sensor 232 will instruct the external power source 700 connected to the air purification module 100 to keep supplying power to the controller 500. In another embodiment of the present application, the panel member 300 is configured to include four panels or five panels or more. In an embodiment of the present application, the specific configuration of the panel member 300 may be as follows:

In the first aspect, a panel 312 in the above-mentioned panel member 300 is a biodegradable soft polyurethane low-resilience memory foam panel for removing volatile organic compounds and filtering out large-diameter particles, and is equipped with special sensors to monitor the cleanliness of the panel, and the special sensors can alert maintenance personnel when the cleanliness of the panel drops below a predetermined threshold.

In the second aspect, the two panels in the above-mentioned panel group 300 are a first foam metal panel 322 and a second foam metal panel 324, and the surrounding edges of the first foam metal panel 322 and the second foam metal panel 324 are tightly sealed with insulating materials. The first foam metal panel 322 and the second foam metal panel 324 will be connected to the high voltage direct current generator 600, specifically, the first foam metal panel 322 is connected to the positive electrode of the high voltage direct current generator 600, and the second foam metal panel 324 is connected to the negative electrode of the high voltage direct current generator 600. The high voltage direct current generator 600 is installed in the second housing 220 outside of the first housing 200, and the first foam metal panel 322 and the second foam metal panel 324 are each equipped with power sensors, so as to facilitate the monitoring of functioning of the panels by the power sensors. The voltage on the metal foam, thus ensuring that the high voltage direct current transmission is strong enough to perform the decontamination process in an air environment. According to the design of the present application, the gap between the adjacent first foam metal panels 322 and the second foam metal panels 324 should be at least 15 cm, and the outer edges of the first and second foam metal panels should be firmly sealed with insulating materials to avoid possible sparks and the resulting danger posed.

In a third aspect, one or both of the panels in the above-mentioned panel member 300 is the third foam metal panel 332 with a photocatalyst coating. According to the embodiments of the present application, the photocatalyst coated on the foam metal panel may be titanium dioxide or other suitable materials. Based on the size of the first housing 200, the use of two third foam metal panels 332 with a photocatalyst coating can further enhance the air purification and decontamination capabilities of the third panel 330. In another embodiment, the above-mentioned panel member 300 includes one or more high efficiency particulate air (HEPA) filter panels as the third panel 330.

According to an embodiment of the present application, the short-wave ultraviolet lamps in the short-wave ultraviolet lamp member 400 can be either conventional short-wave ultraviolet lamps or LED-based short-wave ultraviolet light strips, so as to further enhance the air purification and decontamination efficiency of the third panel 330.

In addition, the LED-based short-wave ultraviolet light strip and the foam metal panel 330 with photocatalyst coating can be used to construct a simple air purification module, and install on the outlet of the air passage in the indoor place provides the air decontamination function.

Referring to FIG. 5, FIG. 5 is a schematic side view of the structure of an independent air purification device provided according to an embodiment of the present application, wherein the arrows in FIG. 5 show the direction of airflow. According to an embodiment of the present application, an air purification device is also provided, which includes the above-mentioned air purification module 100 and a fan 800, wherein the fan 800 is installed at the top of the inner side of the air purification module 100, and is used for guiding airflow from the bottom. The air inlet surface 204 flows to the air exhaust surface 206 at the top, thereby constituting an air purification device that can operate autonomously. Fan 800 may be a commutated EC fan or other suitable fan. In this embodiment, when the door 230 corresponding to the panel member 300, the short-wave ultraviolet lamp member 400, the fan 800 or the DC high voltage generator 600 is opened, the door sensor 232 will indicate that the external power supply 700 connected to the air purification module 100 to automatically cut off, so that users or maintenance personnel can safely carry out follow-up processing according to the relevant workflow.

Furthermore, the present application also provides an intelligent indoor air quality (IAQ) monitoring system. The intelligent system includes a network of air purification modules 100 and a sensor network. The air purification module 100 can be remotely monitored by working with an intelligent sensor network. An embodiment of the present application also includes the integration and combination of Internet, cloud technology, and building information modeling (BIM) and the latest digital twins technology to form a remote smart indoor air quality monitoring system for providing location-specific and indoor air quality information. details.

As the whole operations is running inside the air passage of the air handing unit within a central air-conditioning system, close monitor by various sensors has to be implemented to provide a smart monitor and control of the operations. The comprehensive IAQ Monitoring System is composed of 2 components: the internal control system and remote monitoring system. Data and operations monitoring to be installed within the air purifying system include the following items: remote power switch, machine status checking on power consumption, fan status on air volume, filter cleanliness on pressure differentials and infrared camera, temperature and humidity checking on basic sensors, water leakage on water detector, intensity of UV lamp on radiometer, high voltage direct current discharge on voltage meter. Remote monitoring system is built according to the latest Indoor Air Quality (IAQ) Objectives issued by HK Government dated Jul. 1, 2019, the following parameters are to be considered and checked outside the air purifying system: Carbon Dioxide (CO2), Carbon Monoxide (CO), Respirable Suspended Particulates (PM10), Nitrogen Dioxide (NO2), Ozone (O3), Formaldehyde (HCHO), Total Volatile Organic Compounds (TVOC) and Radon (Rn). Airborne Bacteria can only be inspected through laboratory and mold can be assessed in the form of walkthrough inspection. The IAQ Monitoring System is integrated with Building Information Modelling (BIM) and latest development in Digital Twins to provide exact location as well as detail information on IAQ. Service technicians are instantly dispatched for further inspection whenever there is any concern. The IAQ Monitoring System is based on latest development of Internet of Things (IOT) technologies, cloud-based design and mobile-phone access enabled so that all parties concerned can access the system anywhere, anytime without using any special terminal or equipment.

The foregoing has provided a detailed description of exemplary embodiments of the present application, by way of illustrative and non-limiting example. However, when considered in conjunction with the accompanying drawings and claims, various modifications and adjustments to the above embodiments will be apparent to those skilled participants in the field without departing from the scope of the present application. Accordingly, the proper scope of this application will be determined with reference to the claims.

The invention claimed is:

1. An air purification module for use in an air passage of an air handling unit of a central air-conditioning system, the air purification module (100) comprising a first housing (200): the first housing (200) comprises a closed surface (202), an air inlet surface (204) and an air exhaust surface (206) to allow airflow;

a panel member (300): wherein each panel of the panel member (300) is detachably installed inside the first housing (200);

a short-wave ultraviolet lamp member (400) wherein the short-wave ultraviolet lamp member (400) is installed inside the first housing (200);

a control unit (500) wherein the control unit (500) is installed a second housing (210) outside of the first housing (200); and a high voltage direct current generator (600) adapted to provide a pulsed direct current electric field, wherein the high voltage direct current generator (600) is installed in a third housing (220) outside of the first housing (200), wherein the pulsed direct current electric field is a high voltage pulsed direct current electric field of 20,000 volts/cm or more, wherein the panel member (300) comprises a first panel (310) comprising a pre-filter panel (312);

a second panel (320) comprising a first foam metal panel (322) and a second foam metal panel (324) adjacently installed, the first foam metal panel (322) and the second foam metal panel (324) are respectively connected to positive and negative electrodes of the high voltage direct current generator (600), wherein the first foam metal panel (322) and the second foam metal panel (324) are separated by a gap of at least 15 cm;

a third panel (330) comprising a plurality of third foam metal panels (332) having a photocatalyst coating, wherein the first panel (310), the second panel (320) and the third panel (330) are sequentially arranged in parallel in a direction from the air inlet surface (204) to the air exhaust surface (206), wherein the second panel (320) is adjacently installed with the first panel (310), and wherein the third panel (330) is adjacently installed with the second panel (320).

2. The air purification module according to claim 1, wherein the pre-filter panel (312) comprises a polyurethane low-resilience memory foam, and the pre-filter panel (312) comprises a first sensor (314) for monitoring cleanliness of the pre-filter panel (312).

3. The air purification module according to claim 1, wherein the short-wave ultraviolet lamp member (400) comprises one or more shortwave UV lamps installed between the second panel (320) and the third panel (330).

4. The air purification module according to claim 1, wherein the short-wave ultraviolet lamp member (400) comprises one or more LED-based shortwave UV light strips installed between the second panel (320) and the third panel (330).

5. The air purification module according to claim 1, wherein the first foam metal panel (322) and the second foam metal panel (324) each comprise a second sensor (326) for monitoring voltage applied to the second panel (320).

6. The air purification module according to claim 1, wherein the photocatalyst layer on the third foam metal panel (332) is a titanium dioxide electroplating layer.

7. The air purification module according to claim 1, wherein the air purification module (100) is connected with an external power supply (700).

8. The air purification module according to claim 7, wherein the first housing (200), the second housing (210) and the third housing (220) each comprise a door (230) and the door (230) comprises a door sensor (232), the door sensor (232) being in communication with the external power supply (700) wherein when the door (230) is open, the door sensor (232) signals the external power supply (700) to disconnect power supply to the first housing (200), the second housing (210) and the third housing (220).

9. The air purification module according to claim 1, where the third foam metal panels (332) having photocatalyst coating are not connected to the positive and negative electrodes of the high voltage direct current generator.

10. An air purification device comprising the air purification module (100) of claim 1 and an electronically controlled fan (800), wherein the electronically controlled fan (800) is installed on the inner side of the air purification module (100) to guide airflow from the air inlet surface (204) to the air exhaust surface (206).

11. An air purification module for use in an air passage of an air handling unit of a central air-conditioning system, the air purification module (100) comprising a first housing (200): the first housing (200) comprises a closed surface (202), an air inlet surface (204) and an air exhaust surface (206) to allow airflow;

a panel member (300): wherein each panel of the panel member (300) is detachably installed inside the first housing (200);

a short-wave ultraviolet lamp member (400) wherein the short-wave ultraviolet lamp member (400) is installed inside the first housing (200);

a control unit (500) wherein the control unit (500) is installed a second housing (210) outside of the first housing (200); and a high voltage direct current generator (600) adapted to provide a pulsed direct current electric field, wherein the high voltage direct current generator (600) is installed in a third housing (220) outside of the first housing (200), wherein the pulsed direct current electric field is a high voltage pulsed direct current electric field of 20,000 volts/cm or more, wherein the panel member (300) comprises a first panel (310) comprising a pre-filter panel (312);

a second panel (320) comprising a first foam metal panel (322) and a second foam metal panel (324) adjacently installed, the first foam metal panel (322) and the second foam metal panel (324) are respectively connected to positive and negative electrodes of the high voltage direct current generator (600), wherein the first foam metal panel (322) and the second foam metal panel (324) are separated by a gap of at least 15 cm;

a third panel (330) comprising a plurality of third foam metal panels (332) having a photocatalyst coating, wherein the first panel (310), the second panel (320) and the third panel (330) are sequentially arranged in parallel in a direction from the air inlet surface (204) to the air exhaust surface (206), wherein the high voltage pulsed direct current electric field of 20,000 volts/cm or more is capable of instantly killing contaminants which are captured in the first foam metal panel and the second foam metal panel upon discharge of the high voltage pulsed electric field, wherein only the first foam metal panel (322) is connected to the positive electrode of the high voltage direct current generator (600), wherein only the second foam metal panel (324) is connected to the negative electrode of the high voltage direct current generator (600), and wherein the positive electrode of the high voltage direct current generator (600) and the negative electrode of the high voltage direct current generator (600) are the only electrodes of the air purification module.

12. The air purification module according to claim 1, wherein the first foam metal panel and the second foam metal panel are biodegradable.

13. The air purification module according to claim 1, wherein the first foam metal panel and the second foam metal panel include micropores.

14. A method of operating the air purification module according to claim 1, the method comprising providing the air purification module of claim 1;

capturing contaminants in micropores of the first foam metal panel and the second foam metal panel; and applying the pulsed direct current electric field from the high voltage direct current generator, wherein the pulsed direct current electric field is 20,000 volts/cm or more, to thereby instantly kill the captured contaminants in the micropores.

15. An air purification module for use in an air passage of an air handling unit of a central air-conditioning system, the air purification module (100) comprising a first housing (200): the first housing (200) comprises a closed surface (202), an air inlet surface (204) and an air exhaust surface (206) to allow airflow;

a panel member (300): wherein each panel of the panel member (300) is detachably installed inside the first housing (200);

a short-wave ultraviolet lamp member (400) wherein the short-wave ultraviolet lamp member (400) is installed inside the first housing (200);

a control unit (500) wherein the control unit (500) is installed a second housing (210) outside of the first housing (200); and a high voltage direct current generator (600) adapted to provide a pulsed direct current electric field, wherein the high voltage direct current generator (600) is installed in a third housing (220) outside of the first housing (200), wherein the pulsed direct current electric field is a high voltage pulsed direct current electric field of 20,000 volts/cm or more, wherein the panel member (300) comprises a first panel (310) comprising a pre-filter panel (312);

a second panel (320) comprising a first foam metal panel (322) and a second foam metal panel (324) adjacently installed, the first foam metal panel (322) and the second foam metal panel (324) are respectively connected to positive and negative electrodes of the high voltage direct current generator (600), wherein the first foam metal panel (322) and the second foam metal panel (324) are separated by a gap of at least 15 cm;

a third panel (330) comprising a plurality of third foam metal panels (332) having a photocatalyst coating, wherein the first panel (310), the second panel (320) and the third panel (330) are sequentially arranged in parallel in a direction from the air inlet surface (204) to the air exhaust surface (206), wherein the second panel (320) is adjacently installed with the first panel (310), wherein the third panel (330) is adjacently installed with the second panel (320), and wherein the positive electrode of the high voltage direct current generator (600) and the negative electrode of the high voltage direct current generator (600) are the only electrodes of the air purification module.

* * * * *